US010580437B2

(12) United States Patent
Jensen et al.

(10) Patent No.: US 10,580,437 B2
(45) Date of Patent: Mar. 3, 2020

(54) VOICE ACTIVITY DETECTION UNIT AND A HEARING DEVICE COMPRISING A VOICE ACTIVITY DETECTION UNIT

(71) Applicant: Oticon A/S, Smørum (DK)

(72) Inventors: Jesper Jensen, Sørum (DK); Michael Syskind Pedersen, Smørum (DK)

(73) Assignee: OTICON A/S, Smørum (DK)

( * ) Notice: Subject to any disclaimer, the term of this patent is extended or adjusted under 35 U.S.C. 154(b) by 124 days.

(21) Appl. No.: 15/714,260

(22) Filed: Sep. 25, 2017

(65) Prior Publication Data

US 2018/0090158 A1 Mar. 29, 2018

(30) Foreign Application Priority Data

Sep. 26, 2016 (EP) ..... 16190708

(51) Int. Cl.
*G10L 25/78* (2013.01)
*G10L 25/84* (2013.01)
(Continued)

(52) U.S. Cl.
CPC ..... *G10L 25/84* (2013.01); *G10L 25/21* (2013.01); *G10L 25/90* (2013.01); *H04R 3/005* (2013.01);
(Continued)

(58) Field of Classification Search
CPC ..... G10L 25/78
See application file for complete search history.

(56) References Cited

U.S. PATENT DOCUMENTS 8,098,844 B2 * 1/2012 Elko ..... H04R 3/005 381/122
2011/0264447 A1 10/2011 Visser et al.
(Continued)

FOREIGN PATENT DOCUMENTS

WO WO 2012/061145 A1 5/2012

OTHER PUBLICATIONS

Yu et al., "An Efficient Microphone Array Based Voice Activity Detector for Driver's Speech in Noise and Music Rich In-Vehicle Environments", 2010 IEEE International Conference on Acoustics, Speech and Signal Processing, Mar. 14, 2010, pp. 2834-2837.

*Primary Examiner* — Feng-Tzer Tzeng
(74) *Attorney, Agent, or Firm* — Birch, Stewart, Kolasch & Birch, LLP

(57) ABSTRACT

A voice activity detection unit is configured to receive at least two electric input signals in a number of frequency bands and a number of time instances, k and m being frequency band and time indices, respectively, (k, m) defining a specific time-frequency tile of said electric input signal. The voice activity detection unit is configured to provide a resulting voice activity detection estimate comprising one or more parameters indicative of whether or not a given time-frequency tile contains or to what extent it comprises a target speech signal. The voice activity detection unit comprises a) a first detector for analyzing the time-frequency representation of the electric input signals and identifying spectro-spatial characteristics of said electric input signals, and b) and is configured for providing said resulting voice activity detection estimate in dependence of said spectro-spatial characteristics. The invention may be used in hearing aids, table microphones, speakerphones, etc.

17 Claims, 7 Drawing Sheets

(51) Int. Cl.

| | |
|---|---|
| ***H04R 3/00*** | (2006.01) |
| ***G10L 25/21*** | (2013.01) |
| ***G10L 25/90*** | (2013.01) |
| ***H04R 25/00*** | (2006.01) |
| *G10L 21/0216* | (2013.01) |

(52) U.S. Cl.
CPC ..... *H04R 25/405* (2013.01); *H04R 25/407* (2013.01); *G10L 25/78* (2013.01); *G10L 2021/02166* (2013.01); *H04R 25/353* (2013.01); *H04R 25/552* (2013.01); *H04R 25/554* (2013.01); *H04R 25/558* (2013.01); *H04R 2225/43* (2013.01)

(56) References Cited

U.S. PATENT DOCUMENTS

| | | | | |
|---|---|---|---|---|
| 2011/0288860 | A1 | 11/2011 | Schevciw et al. | |
| 2012/0310641 | A1 | 12/2012 | Niemisto et al. | |
| 2015/0289065 | A1* | 10/2015 | Jensen ..... | H04R 25/552 381/315 |
| 2016/0267920 | A1 | 9/2016 | Sugano | |

* cited by examiner

VOICE ACTIVITY DETECTION UNIT AND A HEARING DEVICE COMPRISING A VOICE ACTIVITY DETECTION UNIT

SUMMARY

The present disclosure relates to voice activity detection, e.g. speech detection, e.g. in portable electronic devices or wearables, such as hearing devices, e.g. hearing aids.

A Voice Activity Detector:

In an aspect of the present application, a voice activity detection unit is provided. The voice activity detection unit is configured to receive a time-frequency representation $Y_i(k,m)$ of at least two electric input signals, i=1, . . . , M, in a number of frequency bands and a number of time instances, k being a frequency band index, m being a time index, and specific values of k and m defining a specific time-frequency tile of said electric input signal. The electric input signals comprises a target speech signal originating from a target signal source and/or a noise signal. The voice activity detection unit is configured to provide a resulting voice activity detection estimate comprising one or more parameters indicative of whether or not a given time-frequency tile comprises or to what extent it comprises the target speech signal. The voice activity detection unit comprises a first detector for analyzing said time-frequency representation $Y_i(k,m)$ of said electric input signals and identifying spectro-spatial characteristics of said electric input signals, and for providing said resulting voice activity detection estimate in dependence of said spectro-spatial characteristics.

Thereby an improved voice activity detection can be provided. In an embodiment, an improved identification of a point sound source (e.g. speech) in a diffuse background noise is provided.

In the present context, the term 'X is estimated or determined in dependence of Y' is taken to mean that the value of Y is influenced by the value of X, e.g. that Y is a function of X.

In the present context, a voice activity detector (typically denoted 'VAD') provides an output in the form or a voice activity detection estimate or measure comprising one or more parameters indicative of whether or not an input signal (at a given time) comprises or to what extent it comprises the target speech signal. The voice activity detection estimate or measure may take the form of a binary or gradual (e.g. probability based) indication of a voice activity, e.g. speech activity, or an intermediate measure thereof, e.g. in the form of a current signal to noise ratio (SNR) or respective target (speech) signal and noise estimates, e.g. estimates of their power or energy content at a given point in time (e.g. on a time-frequency tile or unit level (k,m)).

In an embodiment, the voice activity detection estimate is indicative of speech, or other human utterances involving speech-like elements, e.g. singing or screaming. In an embodiment, the voice activity detection estimate is indicative of speech, or other human utterances involving speech-like elements, from a point-like source, e.g. from a human being at a specific location relative to the location of the voice activity detection unit (e.g. relative to a user wearing a portable hearing device comprising the voice activity detection unit). In an embodiment, an indication of 'speech' is an indication of 'speech from a point (or point-like) source' (e.g. a human being). In an embodiment, an indication of 'no speech' is an indication of 'no speech from a point (or point-like) source' (e.g. a human being).

The spectro-spatial characteristics (and e.g. the voice activity detection estimate) may comprise estimates of the power or energy content originating from a point-like sound source and from other (diffuse) sound sources, respectively, in one or more, or a combination, of said at least two electric input signals at a given point in time, e.g. on a time-frequency tile level (k,m).

Even though the acoustic signal contains early reflections (such as filtering by the head, torso and/or pinna), the signal may be regarded as directive or point-like. Within the same time frame, an early reflection described by look vector $d_{early}(m)$ will be added to the direct sound described by the look vector $d_{direct}(m)$, simply resulting in a new look vector $d_{mixed}(m)$, and the resulting acoustic sound is still described by a rank-one covariance matrix $C_X(m)=\lambda_X(m)d_{mixed}(m)d_{mixed}(m)^H$. If, on the other hand, late reflections e.g. due to walls of a room (e.g. with a delay of more than 50 ms) are present, such later reflections contribute to the sound source appearing to be less distinct (more diffuse) (as reflected by a full-rank covariance matrix) and are preferably treated as noise.

In an embodiment, the voice activity detection estimate is indicative of whether or not a given time frequency tile contains the target speech signal. In an embodiment, the voice activity detection estimate is binary, e.g. assuming two values, e.g. (1, 0), or (SPEECH, NO-SPEECH). In an embodiment, the voice activity detection estimate is gradual, e.g. comprising a number of values larger than two, or spans a continuous range of values, e.g. between a maximum value (e.g. 1, e.g. indicative of speech only) and a minimum value, e.g. 0, e.g. indicative of noise only (no speech elements at all). In an embodiment, the voice activity detection estimate is indicative of whether or not a given time frequency tile is dominated by the target speech signal.

The first detector receives a multitude of electric input signals $Y_i(k,m)$, i=1, . . . , M, where M is larger than or equal to two. In an embodiment, the input signals $Y_i(k,m)$ originate from input transducers located at the same ear of a user. In an embodiment, the input signals $Y_i(k,m)$ originate from input transducers that are spatially separated, e.g. located at respective opposite ears of a user.

In an embodiment, the voice activity detection unit comprises or is connected to at least two input transducers for providing said at least two electric input signals, and wherein the spectro-spatial characteristics comprises acoustic transfer function(s) from the target signal source to the at least two input transducers or relative acoustic transfer function(s) from a reference input transducer to at least one further input transducer, such as to all other input transducers (among said at least two input transducers). In an embodiment, the voice activity detection unit comprises or is connected to at least two input transducers (e.g. microphones), each providing a corresponding electric input signal. In an embodiment, the acoustic transfer function(s) (ATF) or the relative acoustic transfer function(s) (RATF) are determined in a time-frequency representation (k,m). The voice activity detection unit may comprise (or have access to) a database of predefined acoustic transfer functions (or relative acoustic transfer functions) for a number of directions, e.g. horizontal angles, around the user (and possibly for a number of distances to the user).

In an embodiment, the spectro-spatial characteristics (and e.g. the voice activity detection estimate) comprises an estimate of a direction to or a location of the target signal source. The spectro-spatial characteristics may comprise an estimate of a look vector for the electric input signals. In an embodiment, the look vector is represented by a M×1 vector comprising acoustic transfer functions from a target signal source (at a specific location relative to the user) to any input unit (e.g. microphone) delivering electric input signals to the voice activity detection unit (or to a hearing device comprising the voice activity detection unit) relative to a reference input unit (e.g. microphone) among said input units (e.g. microphones).

In an embodiment, the spectro-spatial characteristics (and e.g. the voice activity detection estimate) comprises an estimate of a target signal to noise ratio (SNR) for each time-frequency tile (k,m).

In an embodiment, the estimate of the target signal to noise ratio for each time-frequency tile (k,m) is determined by an energy ratio (PSNR) and is equal to the ratio of the estimate $\hat{\lambda}_x$ of the power spectral density of the target signal at the input transducer in question (e.g. a reference input transducer) to the estimate $\hat{\lambda}_V$ of the power spectral density of the noise signal at the input transducer (e.g. the reference input transducer).

In an embodiment, the resulting voice activity detection estimate comprises or is determined in dependence of said energy ratio (PSNR), e.g. in a post-processing unit. In an embodiment, the resulting voice activity detection estimate is binary, e.g. exhibiting values 1 or 0, e.g. corresponding to SPEECH PRESENT or SPEECH ABSENT. In an embodiment, the resulting voice activity detection estimate is gradual (e.g. between 0 and 1). In an embodiment, the resulting voice active detection estimate is indicative of the presence of speech (from a point-like sound source), if said energy ratio (PSNR) is above a first PSNR-ratio. In an embodiment, the resulting voice activity detection estimate is indicative of the absence of speech, if said energy ratio (PSNR) is below a second PSNR-ratio. In an embodiment, the first and second PSNR-ratios are equal. In an embodiment, the first PSNR-ratio is larger than and second PSNR-ratio. A binary decision mask based on an estimate of signal to noise ratio has been proposed in [8], where the decision mask is equal to 0 for all T-F bins where the local input SNR estimate is smaller than the threshold value of 0 dB, and else equal to 1. A minimum SNR of 0 dB is assumed to be required for listeners to detect usable glimpses from the target speech signal that will aid intelligibility.

In an embodiment, the voice activity detection unit comprises a second detector for analyzing a time-frequency representation Y(k,m) of at least one electric input signal, e.g. at least one of said electric input signals $Y_i(k,m)$, e.g. a reference microphone, and identifying spectro-temporal characteristics of said electric input signal, and providing a voice activity detection estimate (comprising one or more parameters indicative of whether or not the signal comprises or to what extent it comprises the target speech signal) in dependence of said spectro-temporal characteristics. In an embodiment, the voice activity detection estimate of the second detector is provided in a time-frequency representation (k',m'), where k' and m' are frequency and time indices, respectively. In an embodiment, the voice activity detection estimate of the second detector is provided for each time frequency tile (k,m). In an embodiment, the second detector receives a single electric input signal Y(k,m). Alternatively, the second detector may receive two or more of the electric input signals $Y_i(k,m)$, i=1, . . . , M.

In an embodiment, M=two or more, e.g. three or four, or more.

Toice activity detection unit may be configured to base the resulting voice activity detection estimate on analysis of a combination of spectro-temporal characteristics of speech sources (reflecting that average speech is characterized by its amplitude modulation, e.g. defined by a modulation depth), and spectro-spatial characteristics (reflecting that the useful part of speech signals impinging on a microphone array tends to be coherent or directive, i.e. originate from a point-like (localized) source). In an embodiment, the voice activity detection unit is configured to base the resulting voice activity detection estimate on an analysis of spectro-temporal characteristics of one (or more) of the electric input signals followed by an analysis of spectro-spatial characteristics of the at least two electric input signals. In an embodiment, the analysis of spectro-spatial characteristics is based on the analysis of spectro-temporal characteristics.

In an embodiment, the voice activity detection unit is configured to estimate the presence of voice (speech) activity from a source in any spatial position around a user, and to provide information about its position (e.g. a direction to it).

In an embodiment, the voice activity detection unit is configured to base the resulting voice activity detection estimate on a combination of the temporal and spatial characteristics of speech, e.g. in a serial configuration (e.g. where temporal characteristics are used as input to determine spatial characteristics).

In an embodiment, the voice activity detection unit comprises a second detector providing a preliminary voice activity detection estimate based on analysis of amplitude modulation of one or more of the at least two electric input signals and a first detector providing data indicative of the presence or absence of, and a direction to, point-like (localized) sound sources, based on a combination of the at least two electric input signals and the preliminary voice activity detection estimate.

In an embodiment, first detector is configured to base the data indicative of the presence or absence of, and possibly a direction to, point-like (localized) sound sources, on a signal model. In an embodiment, the signal model assumes that target signal X(k,m) and noise signals V(k,m) are un-correlated so that a time-frequency representation of an $i^{th}$ electric input signal $Y_i(k,m)$ can be written as $Y_i(k,m)=X_i(k,m)+V_i(k,m)$, where k is a frequency index, and m is a time (frame) index. In an embodiment, the first detector is configured to provide estimates ($\hat{\lambda}_X(k,m)$, $\hat{d}(k,m)$, $\hat{\lambda}_V(k,m)$) of parameters $\lambda_X(k,m)$, d(k,m), $\lambda_V(k,m)$ of the signal model, estimated from the noisy observations $Y_i(k,m)$ (and optionally on the preliminary voice activity detection estimate), where $\hat{\lambda}_x(k,m)$ and $\hat{\lambda}_V(k,m)$ represent estimates of power spectral densities of the target signal and the noise signal, respectively, and $\hat{d}(k,m)$ represents information about the transfer functions (or relative transfer functions) of sound from a given direction to each of the input units (e.g. as provided by a look vector). In an embodiment, the first detector is configured to provide data indicative of the presence or absence of, and a direction to, point-like (localized) sound sources, and where such data include the estimates ($\hat{\lambda}_X(k,m)$, $\hat{d}(k,m)$, $\hat{\lambda}_V(k,m)$) of the parameters $\lambda_X(k,m)$, d(k,m), $\lambda_V(k,m)$ of the signal model.

In an embodiment, the voice activity detection estimate of the second detector is provided as an input to said first detector. In an embodiment, the voice activity detection estimate of the second detector comprises a covariance matrix, e.g. a noise covariance matrix. In an embodiment, the voice activity detection unit is configured to provide that the first and second detectors work in parallel, so that their outputs are fed to a post-processing unit and evaluated to provide the (resulting) voice activity detection estimate. In an embodiment, the voice activity detection unit is configured to provide that the output of the first detector is used as input to the second detector (in a serial configuration).

In an embodiment, the voice activity detection unit comprises a multitude of first and second detectors coupled in series or parallel or a combination of series and parallel. The voice activity detection unit may comprise a serial connection of a second detector followed by two first detectors (see e.g. FIG. 6).

In an embodiment, the spectro-temporal characteristics (and e.g. the voice activity detection estimate) comprise a measure of modulation, pitch, or a statistical measure, e.g. a (noise) covariance matrix, of said electric input signal(s), or a combination thereof. In an embodiment, said measure of modulation is a modulation depth or a modulation index. In an embodiment, said statistical measure is representative of a statistical distribution of Fourier coefficients (e.g. short-time Fourier coefficients (STFT coefficients)) or a likelihood ratio representing the electric input signal(s).

In an embodiment, the voice activity detection estimate of said second detector provides a preliminary indication of whether speech is present or absent in a given time-frequency tile (k,m) of the electric input signal (e.g. in the form of a noise covariance matrix), and wherein the first detector is configured to further analyze the time-frequency tiles (k",m") for which the preliminary voice activity detection estimate indicates the presence of speech.

In an embodiment, the first detector is configured to further analyze the time-frequency tiles (k",m") for which the preliminary voice activity detection estimate indicates the presence of speech with a view to whether the sound energy is estimated to be directive or diffuse, corresponding to the voice activity detection estimate indicating the presence or absence of speech from the target signal source, respectively. In an embodiment, the sound energy is estimated to be directive, if the energy ratio is larger than a first PSNR ratio, corresponding to the voice activity detection estimate indicating the presence of speech, e.g. from a single point-like target signal source (directive sound energy). In an embodiment, the sound energy is estimated to be diffuse, if the energy ratio is smaller than a second PSNR ratio, corresponding to the voice activity detection estimate indicating the absence of speech from a single point-like target signal source (diffuse sound energy).

A Hearing Device Comprising a Voice Activity Detector:

In an aspect, a hearing device comprising a voice activity detection unit described above, in the 'detailed description of embodiments' or in the claims is provided by the present disclosure.

In a particular embodiment, the voice activity detection unit is configured for determining whether or not an input signal comprises a voice signal (at a given point in time) from a point-like target signal source. A voice signal is in the present context taken to include a speech signal from a human being. It may also include other forms of utterances generated by the human speech system (e.g. singing). In an embodiment, the voice activity detection unit is adapted to classify a current acoustic environment of the user as a SPEECH or NO-SPEECH environment. This has the advantage that time segments of the electric microphone signal comprising human utterances (e.g. speech) in the user's environment can be identified, and thus separated from time segments only comprising other sound sources (e.g. diffuse speech signals, e.g. due to reverberation, or artificially generated noise). In an embodiment, the voice activity detector is adapted to detect as a voice also the user's own voice. Alternatively, the voice activity detector is adapted to exclude a user's own voice from the detection of a voice.

In an embodiment, the hearing device comprises an own voice activity detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the hearing aid comprises a hearing instrument, e.g. a hearing instrument adapted for being located at the ear or fully or partially in the ear canal of a user, or for being fully or partially implanted in the head of the user.

In an embodiment, the hearing device comprises a hearing aid, a headset, an earphone, an ear protection device or a combination thereof. In an embodiment, the hearing device is or comprises a hearing aid In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound. In an embodiment, the hearing device comprises a multitude M of input transducers, e.g. microphones, each providing an electric input signal, and respective analysis filter banks for providing each of said electric input signals in a time-frequency representation $Y_i(k,m)$, $i=1, \ldots, M$. In an embodiment, the hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. In an embodiment, the hearing device comprises a multi-input beamformer filtering unit for spatially filtering M input signals $Y_i(k,m)$, $i=1, \ldots, M$, and providing a beamformed signal. In an embodiment, the beamformer filtering unit is controlled in dependence of the (resulting) voice activity detection estimate. In an embodiment, the hearing device comprises a single channel post filtering unit for providing a further noise reduction of the spatially filtered, beamformed signal. In an embodiment, the hearing device comprises a signal to noise ratio-to-gain conversion unit for translating a signal to noise ratio estimated by the voice activity detection unit to a gain, which is applied to the beamformed signal in the single channel post filtering unit.

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. A digital sample x has a length in time of $1/f_s$, e.g. 50 s, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing assistance device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, sound sources providing signals with sound levels below a certain threshold level are disregarded in the voice activity detection procedure.

In an embodiment, the hearing device further comprises other relevant functionality for the application in question, e.g. feedback estimation and/or cancellation, compression, noise reduction, etc.

Use:

In an aspect, use of a hearing device as described above, in the 'detailed description of embodiments' and in the claims, is moreover provided. In an embodiment, use is provided in a hearing aid. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of detecting voice activity in an acoustic sound field is furthermore provided by the present application. The method comprises analyzing a time-frequency representation $Y_i(k,m)$ of at least two electric input signals, i=1, . . . , M, comprising a target speech signal originating from a target signal source and/or a noise signal originating from one or more other signal sources than said target signal source, said target signal source and said one or more other signal sources forming part of or constituting said acoustic sound field, and identifying spectro-spatial characteristics of said electric input signals, and providing a resulting voice activity detection estimate depending on said spectro-spatial characteristics, the resulting voice activity detection estimate comprising one or more parameters indicative of whether or not a given time-frequency tile (k,m) comprises or to what extent it comprises the target speech signal.

In an embodiment, the resulting voice activity detection estimate is based on analysis of a combination of spectro-temporal characteristics of speech sources reflecting that average speech is characterized by its amplitude modulation (e.g. defined by a modulation depth), and spectro-spatial characteristics reflecting that the useful part of speech signals impinging on a microphone array tends to be coherent or directive (i.e. originate from a point-like (localized) source).

In an embodiment, the method comprises detecting a point sound source (e.g. speech, directive sound energy) in a diffuse background noise (diffuse sound energy) based on an estimate of the target signal to noise ratio for each time-frequency tile (k,m), e.g. determined by an energy ratio (PSNR). In an embodiment, the energy ratio (PSNR) of a given electric input signal is equal to the ratio of an estimate $\hat{\lambda}_x$ of the power spectral density of the target signal at the input transducer in question (e.g. a reference input transducer) to the estimate $\hat{\lambda}_V$ of the power spectral density of the noise signal at that input transducer (e.g. the reference input transducer). In an embodiment, the sound energy is estimated to be directive, if the energy ratio is larger than a first PSNR ratio (PSNR1), corresponding to the resulting voice activity detection estimate indicating the presence of speech, e.g. from a single point-like target signal source (directive sound energy). In an embodiment, the sound energy is estimated to be diffuse, if the energy ratio is smaller than a second PSNR ratio (PSNR2), corresponding to the resulting voice activity detection estimate indicating the absence of speech from a single point-like target signal source (diffuse sound energy).

It is intended that some or all of the structural features of the voice activity detection unit described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system. In an embodiment, the binaural hearing system comprises a multi-input beamformer filtering unit that receives inputs from input transducers located at both ears of the user (e.g. in left and right hearing devices of the binaural hearing system). In an embodiment, each of the hearing devices comprises a multi-input beamformer filtering unit that receives inputs from input transducers located at the ear where the hearing device is located (the input transducer(s), e.g. microphone(s), being e.g. located in said hearing device).

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system. In an embodiment, the APP is configured to run on the hearing device (e.g. a hearing aid) itself.

Definitions

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing aids, table microphones (e.g. speakerphones). The disclosure may e.g. further be useful in applications such as handsfree telephone systems, mobile telephones, teleconferencing systems, public address systems, karaoke systems, classroom amplification systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1A:
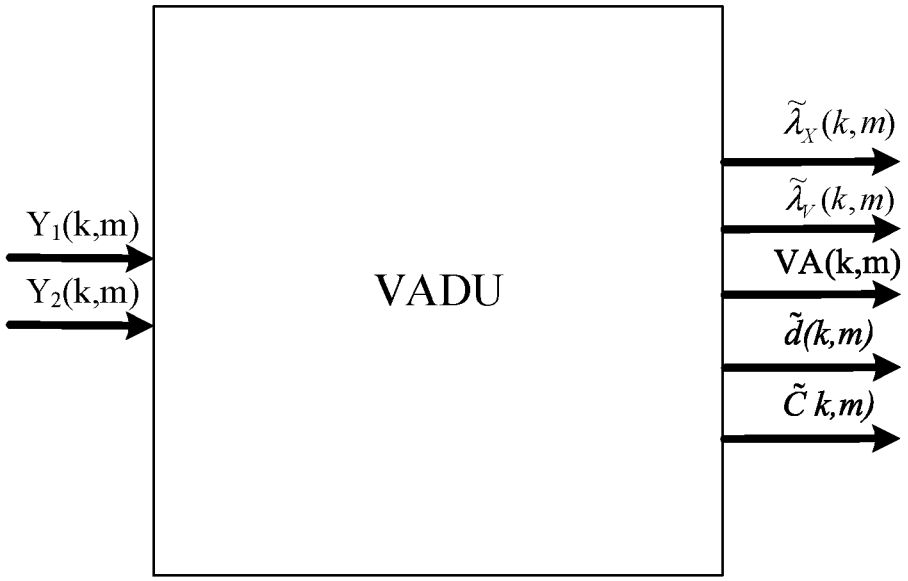
FIG. 1A symbolically shows a voice activity detection unit for providing a voice activity estimation signal based on a two electric input signals in the time frequency domain, and FIG. 1B symbolically shows a voice activity detection unit for providing a voice activity estimation signal based on a multitude M of electric input signals (M>2) in the time frequency domain, FIG. 2A schematically shows a time variant analogue signal (Amplitude vs time) and its digitization in samples, the samples being arranged in a number of time frames, each comprising a number $N_s$ of samples.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, in particular with voice activity detection, specifically with voice activity detection for hearing aid systems based on spectro-spatial signal characteristics, e.g. in combination with voice activity detection based on spectro-temporal signal characteristics.

Often, the signal-of-interest for hearing aid users is a speech signal, e.g., produced by conversational partners. Many signal processing algorithms on-board state-of-the-art hearing aids have as their basic goal to present in a suitable way (i.e., amplified, enhanced, etc.) the target speech signal to the hearing aid user. To do so, these signal processing algorithms rely on some kind of voice-activity detection mechanism: if a target speech signal is present in the microphone signal(s), the signal(s) may be processed differently than if the target speech signal is absent. Furthermore, if a target speech signal is active, it is of value for many hearing aid signal processing algorithms do get information about, where the speech source is located with respect to the microphone(s) of the hearing aid system.

In the present disclosure, an algorithm for speech activity detection is proposed. The proposed algorithm estimates if one or more (potentially noisy) microphone signals contain an underlying target speech signal, and if so, the algorithm provides information about the direction of the speech source relative to the microphone(s).

Many methods have been proposed for speech activity detection (or, more generally, speech presence probability estimation). Single-microphone methods often rely on the observation that the modulation depth of a noisy speech signal (e.g., observed within frequency sub-bands) is higher, when speech is present, than if speech is absent, see e.g., chapter 9 in [1], chapters 5 and 6 in [2], and the references therein. Methods based on multiple microphones have also been proposed, see e.g., [3], which estimates to which extent a speech signal is active from a particular, known direction.

The disclosure aims at estimating whether a target speech signal is active (at a given time and/or frequency). Embodiments of the disclosure aims at estimating whether a target speech signal is active from any spatial position. Embodiments of the disclosure aims at providing information about such position of or direction to a target speech signal (e.g. relative to a microphone picking up the signal).

The present disclosure describes a voice activity detector based on spectro-spatial signal characteristics of an electric input signal from a microphone (in practice from at least two spatially separated microphones). In an embodiment, a voice activity detector based on a combination of spectro-temporal characteristics (e.g., the modulation depth), and spectro-spatial characteristics (e.g. that the useful part of speech signals impinging on a microphone array tends to be coherent, or directive) is provided. The present disclosure further describes a hearing device, e.g. a hearing aid, comprising a voice activity detector according to the present disclosure.

Figure 1B:
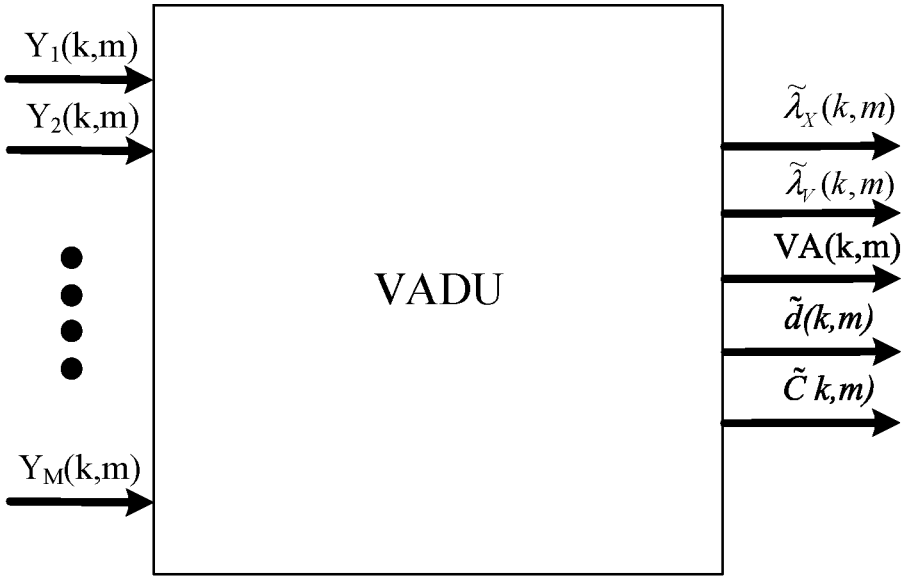

FIGS. 1A and 1B shows a voice activity detection unit (VADU) configured to receive a time-frequency representation $Y_1(k,m)$, $Y_2(k,m)$ of at least two electric input signals (FIG. 1A) or to receive a multitude of electric input signals $Y_i(k,m)$, i=1, 2, . . . , M (M>2) (FIG. 1B) in a number of frequency bands and a number of time instances, k being a frequency band index, m being a time index. Specific values of k and m define a specific time-frequency tile (or bin) of the electric input signal, cf. e.g. FIG. 2B. The electric input signal ($Y_i(k,m)$, i=1, . . . , M) comprises a target signal X(k,m) originating from a target signal source (e.g. voice utterances from a human being, typically speech) and/or a noise signal V(k,m). The voice activity detection unit (VADU) is configured to provide a (resulting) voice activity detection estimate comprising one or more parameters indicative of whether or not a given time-frequency tile (k,m) contains, or to what extent it comprises, the target speech signal. The embodiment in FIGS. 1A and 1B provides the voice activity detection estimate, e.g. one or more of a) power spectral densites $\hat{\lambda}_x(k,m)$ and $\hat{\lambda}_V(k,m)$, of the target signal and the noise signal, respectively, b) a binaural or probability based speech detection indication VA(k,m), c) an estimate of a look vector $\hat{d}(k,m)$, d) an estimate of a (noise) covariance matrix $\hat{C}(k,m)$. In FIG. 1A, the voice activity detection estimate is based on the two electric input signals $Y_1(k,m)$, $Y_2(k,m)$, received from an input unit, e.g. comprising an input transducer, e.g. a microphone (e.g. two microphones). The embodiment in FIG. 1B provides the voice activity detection estimate based on a multitude M of electric input signal $Y_i(k,m)$ (M>2) received from an input unit, e.g. comprising an input transducer, such as a microphone (e.g. M microphones). In an embodiment, the input unit comprises an analysis filter bank for converting a time domain signal to a signal in the time frequency domain.

Figure 2A:
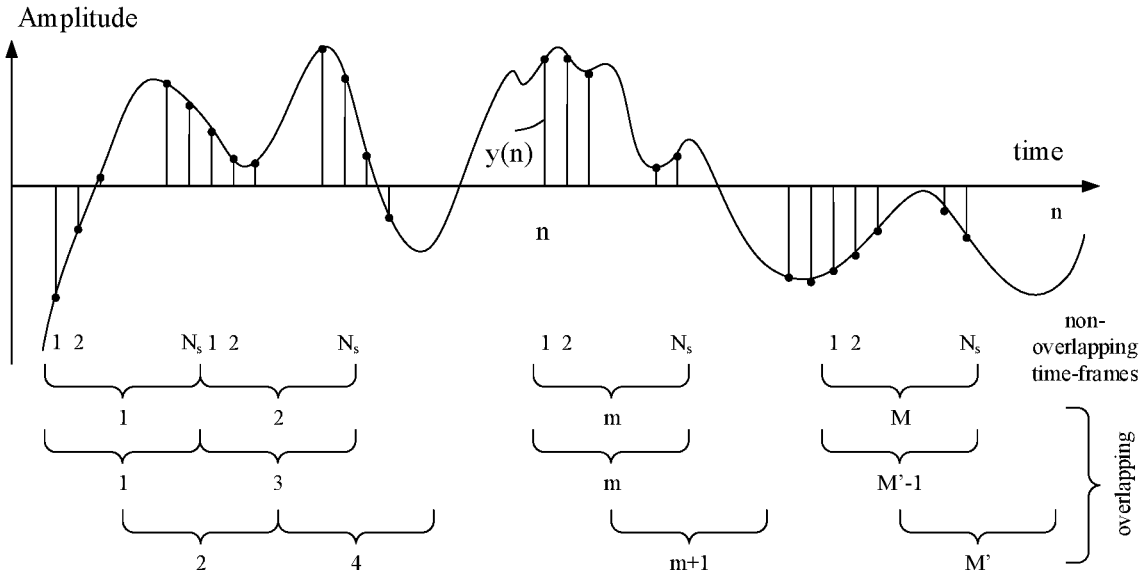
FIG. 2B illustrates a time-frequency map representation of the time variant electric signal of FIG. 2A.

FIG. 2A schematically shows a time variant analogue signal (Amplitude vs time) and its digitization in samples, the samples being arranged in a number of time frames, each comprising a number $N_s$ of digital samples. FIG. 2A shows an analogue electric signal (solid graph), e.g. representing an acoustic input signal, e.g. from a microphone, which is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples y(n) at discrete points in time n, as indicated by the vertical lines extending from the time axis with solid dots at its endpoint coinciding with the graph, and representing its digital sample value at the corresponding distinct point in time n. Each (audio) sample y(n) represents the value of the acoustic signal at n by a predefined number $N_b$ of bits, $N_b$ being e.g. in the range from 1 to 16 bits. A digital sample y(n) has a length in time of $1/f_s$, e.g. 50 s, for $f_s$=20 kHz. A number of (audio) samples $N_s$ are arranged in a time frame, as schematically illustrated in the lower part of FIG. 2A, where the individual (here uniformly spaced) samples are grouped in time frames (1, 2, . . . , $N_s$)). As also illustrated in the lower part of FIG. 2A, the time frames may be arranged consecutively to be non-overlapping (time frames 1, 2, . . . , m, . . . , M) or overlapping (here 50%, time frames 1, 2, . . . , m, . . . , M'), where m is time frame index. In an embodiment, a time frame comprises 64 audio data samples. Other frame lengths may be used depending on the practical application.

Figure 2B:
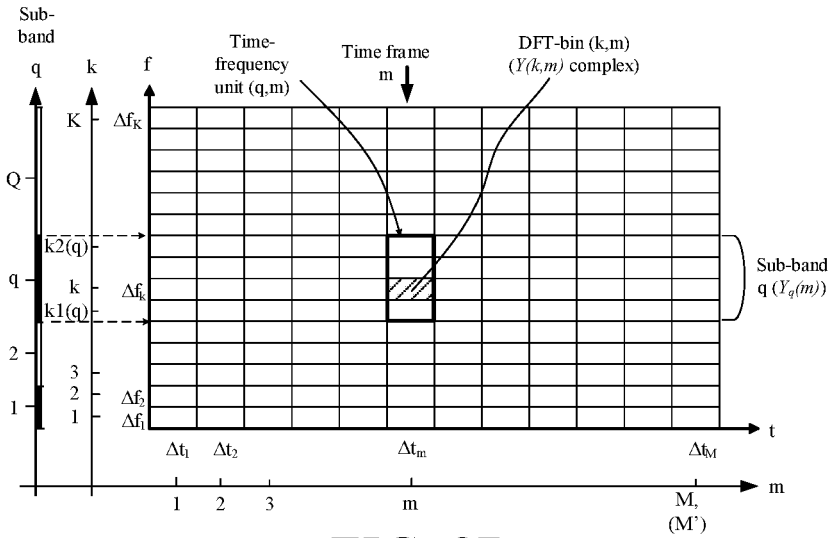

FIG. 2B schematically illustrates a time-frequency representation of the (digitized) time variant electric signal y(n) of FIG. 2A. The time-frequency representation comprises an array or map of corresponding complex or real values of the signal in a particular time and frequency range. The time-frequency representation may e.g. be a result of a Fourier transformation converting the time variant input signal y(n) to a (time variant) signal Y(k,m) in the time-frequency domain. In an embodiment, the Fourier transformation comprises a discrete Fourier transform algorithm (DFT). The frequency range considered by a typical hearing aid (e.g. a hearing aid) from a minimum frequency $f_{min}$ to a maximum frequency $f_{max}$ comprises a part of the typical human audible frequency range from 20 Hz to 20 kHz, e.g. a part of the range from 20 Hz to 12 kHz. In FIG. 2B, the time-frequency representation Y(k,m) of signal y(n) comprises complex values of magnitude and/or phase of the signal in a number of DFT-bins (or tiles) defined by indices (k,m), where k=1, . . . , K represents a number K of frequency values (cf. vertical k-axis in FIG. 2B) and m=1, . . . , M (M') represents a number M (M') of time frames (cf. horizontal m-axis in FIG. 2B). A time frame is defined by a specific time index m and the corresponding K DFT-bins (cf. indication of Time frame m in FIG. 2B). A time frame m represents a frequency spectrum of signal x at time m. A DFT-bin or tile (k,m) comprising a (real) or complex value Y(k,m) of the signal in question is illustrated in FIG. 2B by hatching of the corresponding field in the time-frequency map. Each value of the frequency index k corresponds to a frequency range $\Delta f_k$, as indicated in FIG. 2B by the vertical frequency axis f. Each value of the time index m represents a time frame. The time $\Delta t_m$ spanned by consecutive time indices depend on the length of a time frame (e.g. 25 ms) and the degree of overlap between neighbouring time frames (cf. horizontal t-axis in FIG. 2B).

In the present application, a number Q of (non-uniform) frequency sub-bands with sub-band indices q=1, 2, . . . , J is defined, each sub-band comprising one or more DFT-bins (cf. vertical Sub-band q-axis in FIG. 2B). The $q^{th}$ sub-band (indicated by Sub-band q ($Y_q(m)$) in the right part of FIG. 2B) comprises DFT-bins (or tiles) with lower and upper indices k1(q) and k2(q), respectively, defining lower and upper cut-off frequencies of the $q^{th}$ sub-band, respectively. A specific time-frequency unit (q,m) is defined by a specific time index m and the DFT-bin indices k1(q)-k2(q), as indicated in FIG. 2B by the bold framing around the corresponding DFT-bins (or tiles). A specific time-frequency unit (q,m) contains complex or real values of the $q^{th}$ sub-band signal $Y_q(m)$ at time m. In an embodiment, the frequency sub-bands are third octave bands. $\omega_q$ denote a center frequency of the $q^{th}$ frequency band.

Figure 3A:
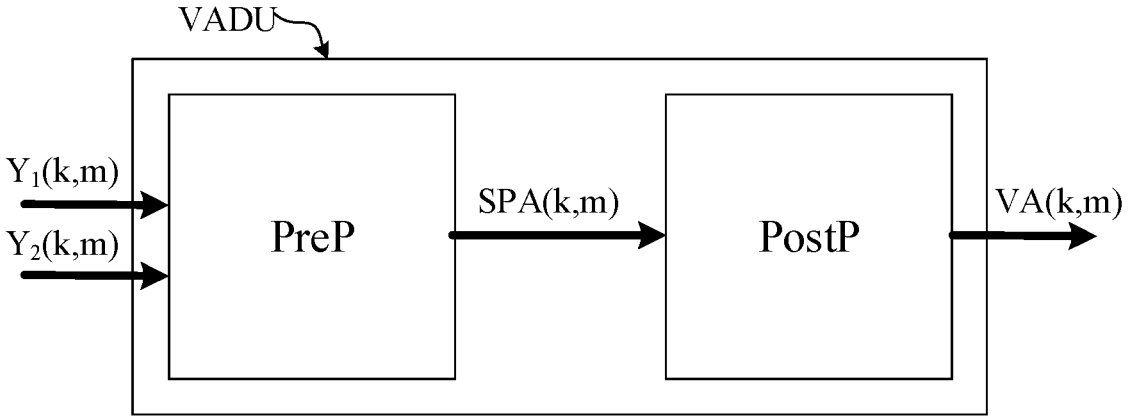
FIG. 3A shows a first embodiment of a voice activity detection unit comprising a pre-processing unit and a post-processing unit.

FIG. 3A shows a first embodiment of a voice activity detection unit (VADU) comprising a pre-processing unit (PreP) and a post-processing unit (PostP). The pre-processing unit (PreP) is configured to analyze a time-frequency representation Y(k,m) of the electric input signal Y(k,m) comprising a target speech signal X(k,m) originating from a target signal source and/or a noise signal V(k,m) originating from one or more other signal sources than said target signal source. The target signal source and said one or more other signal sources form part of or constituting an acoustic sound field around the voice activity detector. The pre-processing unit (PreP) receives at least two electric input signals $Y_1$(k,m), $Y_2$(k,m) (or $Y_i$(k,m), i=1, 2, . . . , M) and is configured to identify spectro-spatial characteristics of the at least two electric input signals and to provide signal SPA (k,m) indicative of such characteristics. The spectro-spatial characteristics are determined for each time-frequency tile of the electric input signal(s). The output signal SPA(k,m) is provided for each time-frequency tile (k,m) or for a subset thereof, e.g. averaged over a number of time frames (Δm) or averaged over a frequency range Δk (comprising a number of frequency bands), cf. e.g. FIG. 2B. The output signal SPA(k,m) comprising spectro-spatial characteristics of the electric input signal(s) may e.g. represent a signal to noise ratio SNR(k,m), e.g. interpreted as an indicator of the degree of spatial concentration of the target signal source. The output signal SPA(k,m) of the pre-processing unit (PreP) is fed to the post-processing unit (PostP), which determines a voice activity detection estimate VA(k,m) (for each time-frequency tile (k,m)) in dependence of said spectro-spatial characteristics SPA (k,m).

Figure 3B:
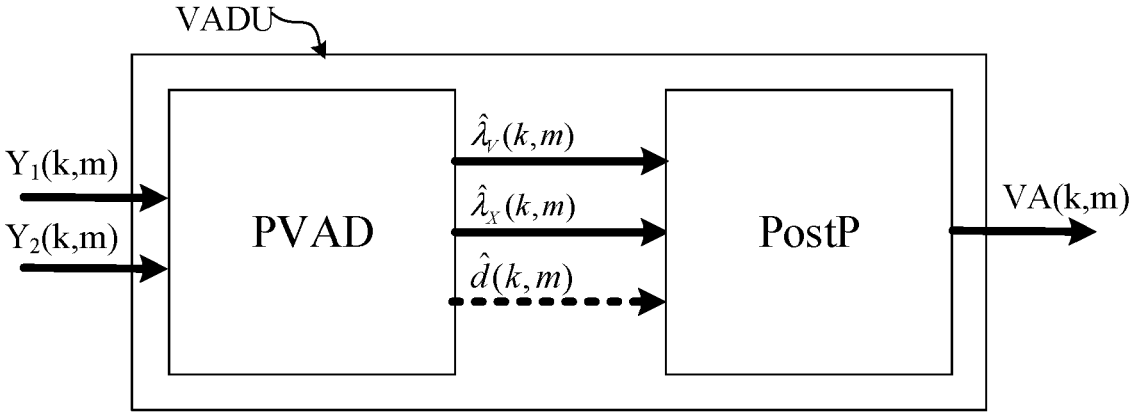
FIG. 3B shows a second embodiment of a voice activity detection unit as in FIG. 3A, wherein the pre-processing unit comprises a first detector according to the present disclosure.

FIG. 3B shows a second embodiment of a voice activity detection unit (VADU) as in FIG. 3A, wherein the pre-processing unit (PreP) comprises a first voice activity detector (PVAD) according to the present disclosure. The first voice activity detector (PVAD) is configured to analyze the time-frequency representation Y(k,m) of the electric input signals $Y_i$(k,m) and to identify spectro-spatial characteristics of said electric input signals. The first voice activity detector (PVAD) provides signals $\hat{\lambda}_X$(k,m), $\hat{\lambda}_V$(k,m), and optionally $\hat{d}$(k,m) to a post-processing unit (PostP). The signals $\hat{\lambda}_X$(k,m), $\hat{\lambda}_V$(k,m), (or $\hat{\lambda}_{X,i}$(k,m), $\hat{\lambda}_{V,i}$(k,m), i=1, . . . , M, here M=2) represent estimates of the power spectral density of the target signal at an input transducer (e.g. a reference input transducer) and of the power spectral density of the noise signal at the input transducer (e.g. a reference input transducer), respectively. The optional signal $\hat{d}$(k,m), also termed a look vector, is an M dimensional vector comprising the acoustic transfer function(s) (ATF), or the relative acoustic transfer function(s) (RATF), in a time-frequency representation (k,m). M is the number of input units, e.g. microphones, M≥2. The post-processing unit (PostP) determines the voice activity detection estimate VA(k,m) in dependence of the energy ratio PSNR=$\hat{\lambda}_x$(k,m)/$\hat{\lambda}_V$(k,m) and optionally of the look vector $\hat{d}$(k,m). In an embodiment, the look vector is fed to a beamformer filtering unit and e.g. used in the estimate of beamformer weights (cf. e.g. FIG. 7). In an embodiment, the energy ratio PSNR is fed to an SNR-to-gain conversion unit to determine respective gains G(k,m) to apply to a single channel post-filter to further remove noise from a (spatially filtered) beamformed signal from the beamformer filtering unit (cf. FIG. 7).

Signal Model:

We assume that M≥2 microphone signals are available. These may be the microphones within a single physical hearing aid unit, or/and microphone signals communicated (wired or wirelessly) from the other hearing aids, from body-worn devices (e.g. an accessory device to the hearing device, e.g. comprising a wireless microphone, or a smartphone), or from communication devices outside the body (e.g. a room or table microphone, or a partner microphone located on a communication partner or a speaker).

Let us assume that the signal $y_i(n)$ reaching the $i^{th}$ microphone can be written as $$y_i(n)=x_i(n)+v_i(n),$$

where $x_i(n)$ is the target signal component at the microphone and $v_i(n)$ is a noise/disturbance component. The signal at each microphone is passed through an analysis filter bank leading to a signal in the time-frequency domain, $$Y_i(k,m)=X_i(k,m)+V_i(k,m),$$

where k is a frequency index, and m is a time (frame) index. For convenience, these spectral coefficients may be thought of as Discrete-Fourier Transform (DFT) coefficients.

Since all operations are identical for each frequency index k, we skip the frequency index for notational convenience wherever possible in the following. For example, instead of $Y_i(k,m)$, we simply write $Y_i(m)$.

For a given frequency index k and time index m, noisy spectral coefficients for each microphone are collected in a vector, $$Y(m)=[Y_1(m)\ Y_2(m)\ \ldots\ Y_M(m)]^T.$$

Vectors V(m) and X(m) for the (unobservable) noise and speech microphone signals, respectively, are defined analogously, so that $$Y(m)=X(m)+V(m).$$

For a given frame index m, and frequency index k (suppressed in the notation), let $d'(m)=[d'_1(m)\ \ldots\ d'_M(m)]$ denote the (generally complex-valued) acoustic transfer function from target sound source to each microphone. It is often more convenient to operate with a normalized version of d'(m). More specifically, let $$d(m)=d'(m)/d'_{i_{ref}}(m)$$

denote the relative acoustic transfer function (RATF) with respect to the $i_{ref}^{th}$ microphone. This implies that the $i_{ref}^{th}$ element in this vector equals one, and the remaining elements describe the acoustic transfer function from the other microphones to this reference microphone.

This means that the noise free microphone vector X(m) (which cannot be observed directly), can be expressed as $$X(m)=d(m)\bar{X}(m),$$

where $\bar{X}(m)$ is the spectral coefficient of the target signal at the reference microphone. When d(m) is known, this model implies that if the speech signal were known at the reference microphone (i.e., the signal $\bar{X}(m)$), then the speech signal at any other microphone would also be known with certainty.

The inter-microphone cross-spectral covariance matrix for the clean signal is then given by $$C_X(m)=\lambda_X(m)d(m)d(m)^H,$$

where H denotes Hermitian transposition, and $\lambda_X(m)=E[|\bar{X}(m)|^2]$ is the power spectral density of the target signal at the reference microphone.

Similarly, the inter-microphone cross-power spectral density matrix of the noise signal impinging on the microphone array is given by, $$C_V(m)=\lambda_V(m)C_V(m_0),\ m>m_0,$$

where $C_V(m_0)$ is the noise covariance matrix of the noise, measured some-time in the past (frame index $m_0$. We assume, without loss of generality, that $C_V(m)$ is scaled such that the diagonal element $(i_{ref}i_{ref})$ equals one. With this convention, $\lambda_V(m)=E[|V_{i_{ref}}(m)|^2]$ is the power spectral density of the noise impinging on the reference microphone. The inter-microphone cross-power spectral density matrix of the noisy signal is then given by $$C_Y(m)=C_X(m)+C_V(m),$$

because the target and noise signals were assumed to be uncorrelated. Inserting expressions from above, we arrive at the following expression for $C_Y(m)$, $$C_Y(m)=\lambda_X(m)d(m)d(m)^H+\lambda_V(m)C_V(m_0),\ m>m_0.$$

The fact that the first term describing the target signal, $\lambda_X(m)d(m)d(m)^H$, is a rank-one matrix implies that the beneficial part (i.e., the target part) of the speech signal is assumed to be coherent/directional [4]. Parts of the speech signal, which are not beneficial, (e.g., signal components due to late-reverberation, which are typically incoherent, i.e., arrive from many simultaneous directions) are captured by the second term. This second term implies that the sum of all disturbance components (e.g., due to late reverberation, additive noise sources, etc.) can be described up to a scalar multiplication by the cross-power spectral density matrix $C_V(m_0)$ [5].

Figure 4:
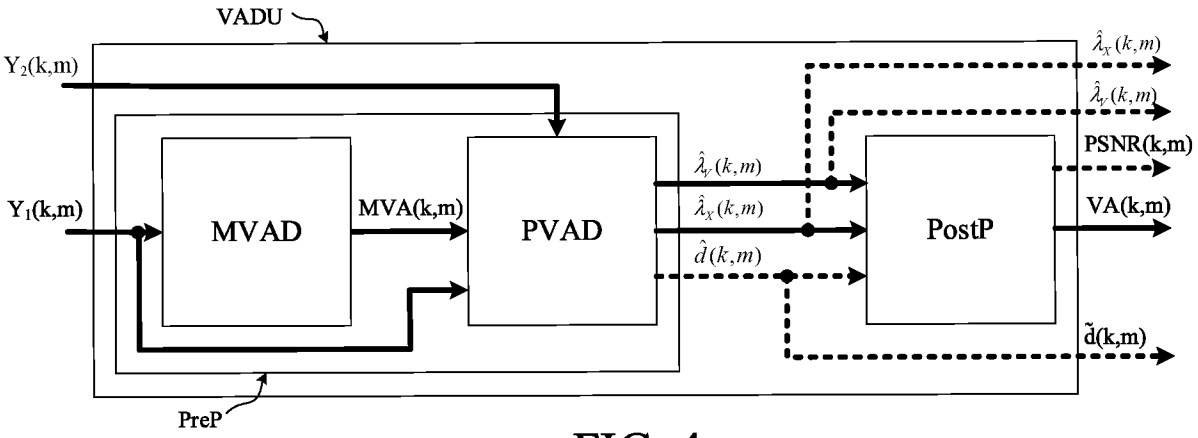
FIG. 4 shows a third embodiment of a voice activity detection unit comprising first and second detectors.

Joint Voice Activity Detection and RATF Estimation:

FIG. 4 shows a third embodiment of a voice activity detection unit (VADU) comprising first and second detectors. The embodiment of FIG. 4 comprises the same elements as the embodiment of FIG. 3B. Additionally the pre-processing unit (PreP) comprises a second detector (MVAD). The second detector (MVAD) is configured for analyzing the time-frequency representation Y(k,m) of the electric input signal $Y_1(k,m)$ (or electric input signals $Y_1(k,m)$, $Y_2(k,m)$) and for identifying spectro-temporal characteristics of the electric input signal(s), and providing a preliminary voice activity detection estimate MVA(k,m) in dependence of the spectro-temporal characteristics. In the present embodiment, the spectro-temporal characteristics comprise a measure of (temporal) modulation e.g. a modulation index or a modulation depth of the electric input signal(s). The preliminary voice activity detection estimate MVA(k,m) is e.g. provided for each time frequency tile (k,m), and used as an input to the first detector (PVAD) in addition to the electric input signals $Y_1(k,m)$, $Y_2(k,m)$ (or generally, electric input signals $Y_i(k,m)$, i=1, . . . , M). The preliminary voice activity detection estimate MVA(k,m) may e.g. comprise (or be constituted by) an estimate of the noise covariance matrix $\hat{C}_V(k,m)$. The post-processing unit (PostP) is configured to determine the (resulting) voice activity detection estimate VA(k,m) in dependence of the energy ratio $PSNR=\hat{\lambda}_x(k,m)/\hat{\lambda}_V(k,m)$ and optionally of the look vector $\hat{d}(k,m)$. The look vector $\hat{d}(k,m)$ and/or the estimated signal to noise ratio PSNR(k,m), and/or the respective power spectral densities, $\hat{\lambda}_x(k,m)$ and $\hat{\lambda}_V(k,m)$, of the target signal and the noise signal, respectively, may (in addition to the resulting voice activity detection estimate VA(k,m)) be provided as optional output signals from the voice detection unit (VADU) as illustrated in FIG. 4 by dashed arrows denoted $\hat{d}(k,m)$, PSNR(k,m), $\hat{\lambda}_x(k,m)$, and $\hat{\lambda}_V(k,m)$, respectively.

The function of the embodiment of a voice detection unit (VADU) shown in FIG. 4 is described in more detail in the following and the method is further illustrated in FIG. 5.

The proposed method is based on the observation that if the parameters of the signal model above, i.e., $\lambda_X(m)$,d(m) and $\lambda_V(m)$, could be estimated from the noisy observations Y(m), then it would be possible to judge, if the noisy observation were originating from a particular point in space; this would be the case if the ratio $\lambda_X(m)/(\lambda_X(m)+\lambda_V(m))$ of point-like energy $\lambda_X(m)$ vs. total energy $\lambda_X(m)+\lambda_V(m)$ impinging on the reference microphone was large (i.e., close to one). Furthermore, in this case, an estimate of the RATF d(m) would provide information about the direction of this point source. On the other hand, if the estimate of $\lambda_X(m)$ was much smaller than the estimate of $\lambda_V(m)$, one might conclude that speech is absent in the time-frequency tile in questions.

The proposed voice activity (VAD) detector/RATF estimator makes decisions about the speech content on a per time-frequency tile basis. Hence, it may be that speech is present at some frequencies but absent at others, within the same time frame. The idea is to combine the point-energy measure outlined above (and described in detail below) with more classical single-microphone, e.g., modulation based VADs to achieve an improved VAD/RATF estimator which relies on both characteristics of speech sources:

1. Speech Signals are Amplitude-Modulated Signals.

This characteristic is used in many existing VAD algorithms to decide if speech is present, see e.g., Chap. 9 in [1], Chaps. 5 and 6 in [2], and the references therein. Let us call this existing algorithm for MVAD (M: "Modulation"), although some of the VAD algorithms in the references above in fact also rely on other signal properties than modulation depth, e.g. statistical distributions of short-time Fourier coefficients, etc.

2. Speech Signals (the Beneficial Part) are Directive/Point-Like.

We propose to decide if this is the case by estimating the parameters of the signal model as outlined above. Specifically, the ratio of estimates $\hat{\lambda}_X(m)/\hat{\lambda}_V(m)$ is an estimate of the point-like-target-signal-to-noise-ratio (PSNR) observed at the reference microphone. If PSNR is high, an estimate $\hat{d}(m)$ of the RATF d(m) carries information about the direction-of-arrival of the target signal. We outline below the algorithm, called PVAD (P: "point-like") which estimates $\lambda_X(m)$, d(m) and $\lambda_V(m)$.

To take into account both characteristics of speech signals, we propose to use a combination of both MVAD and PVAD. Several such combinations may be devised—below we give some examples.

Example—MP-VAD1 (Voice Activity Detection)

Figure 5:
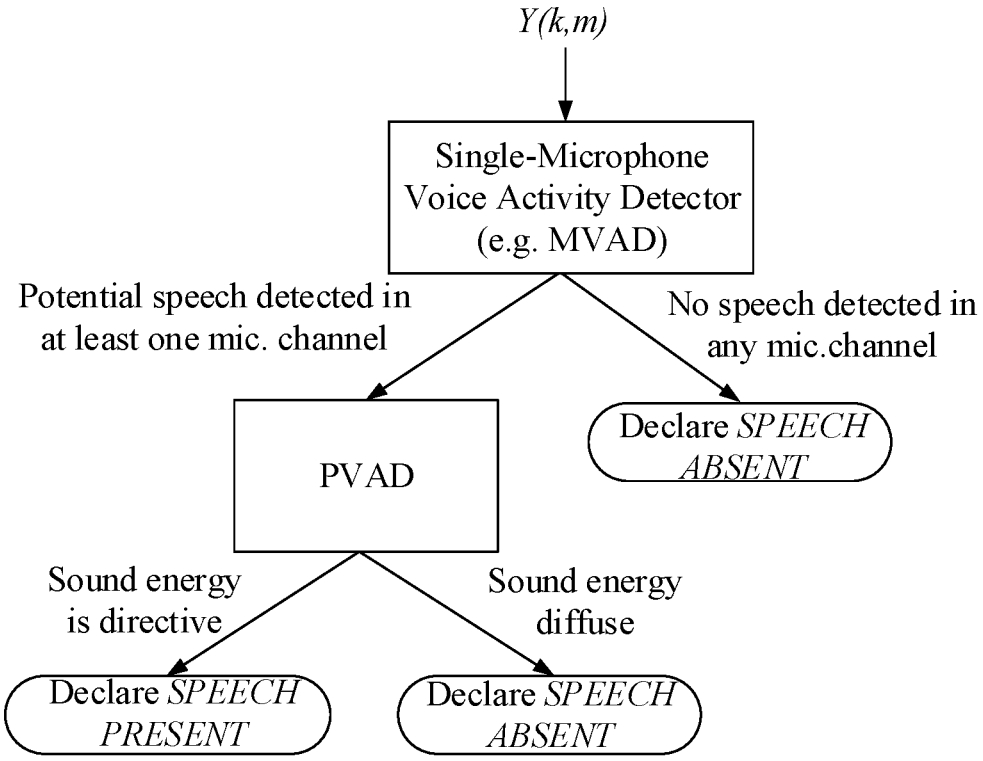
FIG. 5 shows an embodiment of a method of detecting voice activity in an electric input signal, which combines the outputs of first and second detectors.

The example combination is illustrated in FIG. 4 and FIG. 5, and in the following pseudo-code.

FIG. 5 shows an embodiment of a method of detecting voice activity in an electric input signal, which combines the outputs of first and second voice activity detectors.

The VAD decision for a particular time-frequency tile is made based on the current (and past) microphone signals Y(m). A VAD decision is made in two stages. First, the microphone signals in Y(k,m) are analyzed using any traditional single-microphone modulation-depth based VAD algorithm—this algorithm is applied to one, or more, microphone signals individually, or to a fixed linear combination of microphones, i.e., a beamformer pointing towards some desired direction. If this analysis does not reveal speech activity in any of the analyzed microphone channels, then the time-frequency tile is declared to be speech-absent.

If the MVAD analysis cannot rule out speech activity in one or more of the analyzed microphone signals, it means that a target speech signal might be active, and the signal is passed on to the PVAD algorithm to decide if most of the energy impinging on the microphone array is directive, i.e., originates from a concentrated spatial region. If PVAD finds this to be the case, then the incoming signal is both sufficiently modulated and point-like, and the time-frequency tile under analysis is declared to be speech-active. On the other hand, if PVAD finds that the energy is not sufficiently point-like, then the time-frequency tile is declared to be speech-absent. This situation, where the incoming signal shows amplitude modulation, but is not particularly directive, could be the case for the reverberation tail of speech signal produced in reverberant rooms, which is generally not beneficial for speech perception.

Algorithm MP-VAD1 (using MVAD and PVAD):

```
Input: Y (m), m = 0,...
Output: MP-VAD decision (Speech Absent / Speech Present)
  1) Compute MVAD for one, more, or all microphone signals in Y (m) for a particular
     time-frequency tile (frame index m, freq. index suppressed in notation).
  2) Update cpsd matrix for noisy microphone signal
        Ĉ_Y(m) = α_1 Ĉ_Y(m − 1) + (1 − α_1)Y(m)Y^H (m)
  3) If MVAD decides that speech is absent from all analysed microphone signals
        Ĉ_V(m) = α_2 Ĉ_V(m − 1) + (1 − α_2)Y(m)Y^H (m) ;  %update  noise  cpsd
        matrix
        Declare Speech Absent
     else
        Compute [ λ̂_X(m),λ̂_V(m),d̂(m) ] = PVAD(Ĉ_X(m),Ĉ_V(m))
        Compute PSNR(m) =      λ̂_X(m)/(λ̂_V(m) + λ̂_X(m))
           if PSNR(m)<thr1 %sound energy is not sufficiently directive
              Ĉ_V(m) = α_3 Ĉ_V(m − 1) + (1 − α_3)Y(m)Y^H (m) ;  %update  noise  cpsd
     matrix
                 Declare Speech Absent
        Else
              Ĉ_V(m) = Ĉ_V(m − 1); %keep "old" noise cpsd matrix
                 Declare Speech Present
        end
  end
```

It should be noted that steps 1) and 2) are independent of each other and might be reversed in order (cf. e.g. Algorithm MP-VAD2, described below). The scalar parameters $\alpha_1$, $\alpha_2$, $\alpha_3$ are suitably chosen smoothing constants. The parameter thr1 is a suitably chosen threshold parameter. It should be clear that the exact formulation of PSNR(m) is just an example. Other functions of $\hat{\lambda}_X(m)$, $\hat{\lambda}_V(m)$ may also be used. In step 3), PVAD is executed, resulting in $\hat{\lambda}_X(m)$, $\hat{\lambda}_V(n)$ and $\hat{d}(m)$, but only the first two estimates are actually used—in this sense, PVAD may be seen as a computational overkill. In practice other, simpler algorithms, performing only a subset of the algorithmic steps of PVAD (see section 'The PVAD Algorithm' below) can be used. Also, in Step 3, the line "if PSNR(m)<thr1" tests if the sound energy is not sufficiently directive, and, if so, updates the noise cpsd estimate $\hat{C}_V(m)$ using the smoothing constant $\alpha_3$. This hard-threshold-decision may be replaced by a soft-decision-scheme, where $\hat{C}_V(m)$ is updated always, but using a smoothing parameter $0 \le \alpha_3 \le 1$, which—instead of being a constant—is inversely proportional to PSNR(m) (for low PSNRs, $\alpha_3 \approx 1$, so that $\hat{C}_V(m) \approx \hat{C}_V(m-1)$, i.e., the noise cpsd estimate is not updated, and vice-versa).

Algorithm MP-VAD2:

Input: Y (m), m = 0,...
Output: RATF estimate $\hat{d}(m)$, MP-VAD decision (Speech Absent / Speech Present)

1) Update cpsd matrix for noisy microphone signal
   $\hat{C}_Y(m) = \alpha_1 \hat{C}_Y(m-1) + (1-\alpha_1) Y(m) Y^H(m)$
2) Compute MVAD
   If MVAD decides that speech is absent
   $\hat{C}_V(m) = \alpha_2 \hat{C}_V(m-1) + (1-\alpha_2) Y(m) Y^H(m)$ ; %update noise cpsd matrix
   End
3) Compute $[\hat{\lambda}_X(m), \hat{\lambda}_V(m), \hat{d}(m)] = \mathrm{PVAD}(\hat{C}_Y(m), \hat{C}_V(m))$
4) Compute $\mathrm{PSNR}(m) = \hat{\lambda}_X(m)/(\hat{\lambda}_V(m) + \hat{\lambda}_X(m))$
5) If PSNR(m) < thr1
   $\tilde{C}_V(m) = \alpha_3 \tilde{C}_V(m-1) + (1-\alpha_3) Y(m) Y^H(m)$%update refined noise cpsd
   Declare Speech Absent
   Else if PSNR(m) > thr2
   $\tilde{C}_Y(m) = \alpha_4 \tilde{C}_Y(m-1) + (1-\alpha_4) Y(m) Y^H(m)$
   Declare Speech Present
   End
6) Compute $[\tilde{\lambda}_X(m), \tilde{\lambda}_V(m), \tilde{d}(m)] = \mathrm{PVAD}(\tilde{C}_Y(m), \hat{C}_V(m))$

Example—MP-VAD2 (Voice Activity Detection and RATF Estimation)

The second example combination of MVAD and PVAD is described in the pseudo-code for Algorithm MP-VAD2 below. The idea is to use MVAD in an initial stage to update an estimate $\hat{C}_Y(m)$ of the noise cpsd matrix. Then the PSNR is estimated based on PVAD. The PSNR is now used to update a second, refined noise cpsd matrix estimate, $\tilde{C}_V(m)$, and a second, refined noisy cpsd matrix $\tilde{C}_Y(m)$. Based on these refined estimates, PVAD is executed a second time to find a refined estimate of the RATF.

Figure 6:
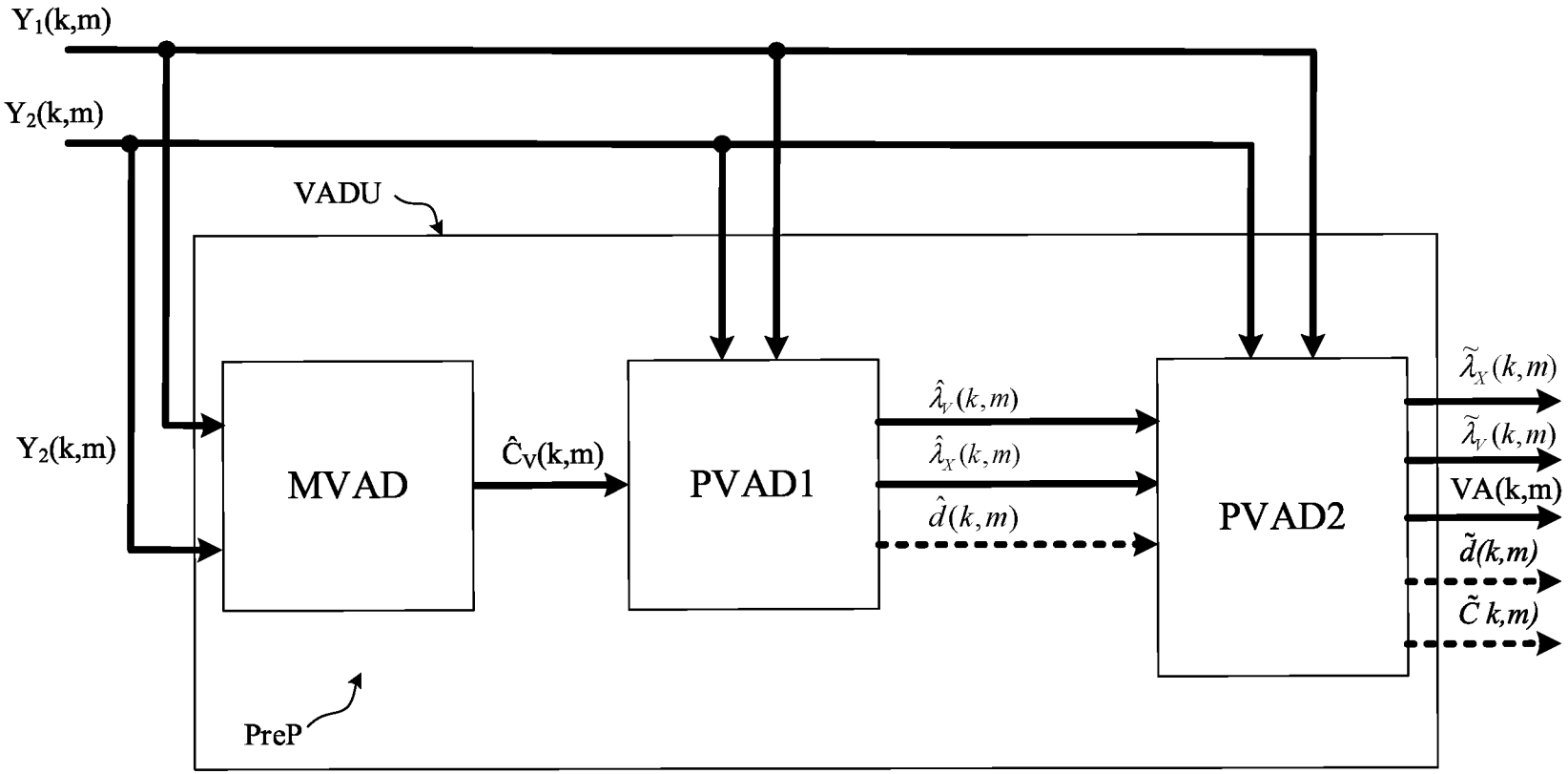
FIG. 6 shows an embodiment of a pre-processing unit comprising a second detector followed by two cascaded first detectors according to the present disclosure.

FIG. 6 shows an embodiment of a voice activity detection unit (VADU) comprising a second detector (MVAD) followed by two cascaded first voice activity detectors (PVAD1, PVAD2) according to the present disclosure. The voice activity detection unit (VADU) illustrated in FIG. 6 has similarities to voice activity detection unit (VADU) illustrated in FIG. 4 and is described in the following procedural steps of Algorithm MP-VAD2. A difference to FIG. 4 is that the second detector in the embodiment of FIG. 6 is configured to receive the first and second electric input signals ($Y_1$, $Y_2$) and to provide a (preliminary) estimate of a noise covariance matrix $\hat{C}_V(k,m)$ based thereon. The covariance matrix $\hat{C}_V(k,m)$ is used as an input to the first one (PVAD1) of the two serially coupled first detectors (PVAD1, PVAD2).

The scalar parameters $\alpha_1$, $\alpha_2$, $\alpha_3$, and $\alpha_4$ are suitably chosen smoothing constants. The parameters thr1, thr2 (thr2≥thr1≥0) are suitably chosen threshold parameters. The lower the threshold thr1 in step 5), the more confidence we have, that $\tilde{C}_Y(m)$ is only updated when the incoming signal is indeed noise-only (the price for choosing thr1 too low, though, is that $\tilde{C}_V(m)$ is updated too rarely to track the changes in the noise field. A similar tradeoff exists with the choice of the threshold thr2 and the update of matrix $\tilde{C}_Y(m)$.

Example—MP-VAD3 (Voice Activity Detection and RATF Estimation)

The third example combination of MVAD and PVAD is described in the pseudo-code for Algorithm MP-VAD3 below. This example algorithm is essentially a simplification of MP-VAD2, which avoids the (potentially computationally expensive) usage of two PVAD executions. Essentially, the first usage of MVAD (step 2 in MP-VAD2) has been skipped, and the first usage of PVAD (steps 3 and 4) have been replaced by MVAD.

Algorithm MP-VAD3:

Input: Y (m), m = 0,...
Output: RATF estimate $\hat{d}(m)$, MP-VAD decision (Speech Absent / Speech Present).

1) Compute MVAD
   If MVAD decides that speech is absent
   $\hat{C}_V(m) = \alpha_1 \hat{C}_V(m-1) + (1-\alpha_1) Y(m) Y^H(m)$ ;
   %update noise cpsd matrix
   Declare Speech Absent
   Else if MVAD decides that speech is present
   $\hat{C}_Y(m) = \alpha_2 \hat{C}_Y(m-1) + (1-\alpha_2) Y(m) Y^H(m)$
   Declare Speech Present
   End
2) Compute $[\hat{\lambda}_X(m), \hat{\lambda}_V(m), \hat{d}(m)] = \mathrm{PVAD}(\hat{C}_Y(m), \hat{C}_V(m))$;
   %only need RATF The scalar parameters $\alpha_1$,$\alpha_2$ are suitably chosen smoothing constants, e.g. between 0 and 1 (the closer $\alpha_i$ is to one, the more weight is given to the latest value and the closer $\alpha_i$ is to zero, the more weight is given to the previous value).

From the examples above, it should be clear that many more reasonable combinations of MVAD and PVAD exist.

The PVAD Algorithm

The example algorithms MP-VAD1, 2, and 3 outlined above all use suitable combinations of two building blocks: MVAD, and PVAD. In the present context, MVAD denotes a known single-microphone VAD algorithm (often, but not necessarily, based on detection of amplitude-modulation). PVAD is an algorithm which estimates the parameters $\lambda_X(m)$, $\lambda_V(m)$ and d(m) based on the signal model outlined below (and earlier in this document). The PVAD algorithm is outlined below.

We can determine to which extent the noisy signal impinging on the microphone array is "point-like" by estimating the model parameters $\lambda_X(m)$, d(m) and $\lambda_V(m)$ from the noisy observations Y(m).

Recall the Signal Model $$C_Y(m)=\lambda_X(m)d(m)d(m)^H+\lambda_V(m)C_V(m_0),$$

where the matrix $C_V(m_0)$ is assumed known. Let us now define the pre-whitening matrix $$F = C_V(m_0)^{-\frac{1}{2}}.$$

Pre- and post-multiplication of F and $F^H$ with $C_Y(m)$ leads to a new matrix $C_Y(m)$, which is given by $$\begin{aligned}\breve{C}_Y(m) &= FC_Y(m)F^H \\ &= \lambda_X(m)\breve{d}(m)\breve{d}(m)^H + \lambda_V(m)I_M,\end{aligned}$$

where $\breve{d}(m)=Fd(m)$ and $I_M$ is an identity matrix. Note that the quantities of interest $\lambda_X(m)$, $\lambda_V(m)$, and $\breve{d}(m)$ may found from an eigen-value decomposition of $\breve{C}_Y(m)$. Specifically, it can be shown that the largest eigenvalue is equal to $\lambda_X(m)+\lambda_V(m)$, whereas the M−1 lowest eigenvalues are all equal to $\lambda_2(m)$. Hence, both $\lambda_X(m)$ and $\lambda_2(m)$ may be identified from the eigenvalues. Furthermore, the vector $\breve{d}(m)$ is equal to the eigenvector associated with the largest eigenvalue. From this eigenvector, the relative transfer function d(m) may be found simply as $d(m)=F^{-1}\breve{d}(m)$.

In practice, the inter-microphone cross-power spectral density matrix of the noisy signal, $C_Y(m)$, can not be observed directly. However, it is easily estimated using a time-average, e.g., $$\hat{C}_Y(m) = \frac{1}{D}\sum_{j=m-D+1}^{m} Y(m)Y(m)^H,$$

based on the D last noisy microphone signals Y(m), or using exponential smoothing as outlined in the MP-VAD algorithm pseudo-code above. Now, the quantities of interest $\lambda_X(m)$, $\lambda_V(m)$, d(m) may be estimated simply by replacing the estimate $\hat{C}_Y(m)$ for the true matrix $C_Y(m)$ in the procedure described above. This practical approach is outlined in the steps below.

Algorithm PVAD:

Input: $\hat{C}_V(m_0)$, $\hat{C}_Y(m)$.
Output: Estimates $\hat{\lambda}_V(m)$, $\hat{\lambda}_X(m)$, $\hat{d}_{(m)}$.
1) Compute estimate $\hat{C}_Y(m)$.
2) Compute $F = C_V(m_0)^{\frac{1}{2}}$.

-continued

Algorithm PVAD:

3) Compute pre-whitened matrix $\breve{C}_Y(m) = F\hat{C}_Y(m)F^H$.
4) Perform eigenvalue decomposition of $\breve{C}_Y(m)$, $\breve{C}_Y(m) = USU^H$, where $U = [u_1 \quad u_2 \ldots u_M]$ have the eigen vectors of $\breve{C}_Y(m)$ as columns, and where $S = \mathrm{diag}([\lambda_1 \quad \lambda_2 \ldots \lambda_M])$ is a diagonal matrix with the eigenvalues arranged in decreasing order.
5) For an estimated matrix $\hat{C}_Y(m)$ the M − 1 lowest eigenvalues are not completely identical. To compute an estimate of $\lambda_V(m)$, the average of the M − 1 lowest eigenvalues is used:

$$\hat{\lambda}_V(m) = \frac{1}{M-1}\sum_{j=2}^{M}\lambda_j.$$

6) An estimate of $\lambda_X(m)$ is found as $\hat{\lambda}_X(m) = \lambda_1 - \hat{\lambda}_V(m)$.
7) An estimate d(m) of the relative transfer function to the dominant point-like sound source is give by $\hat{d}(m) = F^{-1}u_1$.

To reduce computational complexity of the algorithm (and thus save power), step 5 may be simplified to only calculate a subset of the eigen values $\lambda_j$, e.g. only two values. e.g. the largest and the smallest eigenvalue.

Step 7 relies on the assumption that there is only one target signal present—a more general expression is $$\hat{\lambda}_V(m) = \frac{1}{M-K}\sum_{j=K}^{M}\lambda_j,$$

with M>K, where K is an estimate of the number of present target sources—this estimate might be obtained using well-known model order estimators, e.g. based on Akaikes Information Criterion (AIC), or Rissanens Minimum Description Length (MDL), etc., see e.g. [7].

Extensions

The presented methods focus on VAD decisions (and RATF estimates) on a per-time-frequency-tile basis. However, methods exist for improving the VAD decision. Specifically, if it is noted that speech signals are typically broad-band signals with some power at all frequencies, it follows that if speech is present in one time-frequency tile, it is also present at other frequencies (for the same time instant). This may be exploited for merging the time-frequency-tile VAD decisions to VAD decisions on a per-frame basis: for example, the VAD decision for a frame may be defined simply as the majority of VAD decisions per time-frequency tile. Alternatively, the frame may be declared as speech active, if the PSNR in just one of its time-frequency tiles is larger than a preset threshold (following the observation that if speech is present at one frequencies, it must be present at all frequencies). Obviously other ways exist for combining per-time-frequency-tile VAD decisions or PSNR estimates across frequency.

Analogously, it may be argued that if speech is present in the microphones of the left (say) hearing aid, then speech must also be present in the right hearing aid. This observation allows VAD decisions to be combined between the left and right ear hearing aids (merging VAD decisions between hearing aids obviously requires some information to be exchanged between the hearing aids, e.g., using a wireless communication link).

Example Usage: Multi-Microphone Noise Reduction Based on MP-VAD

An obvious usage of the proposed MP-VAD algorithm is for multi-microphone noise reduction in hearing aid systems. Let us assume that an algorithm in the class of proposed MP-VAD algorithms is applied to the noisy microphone signals of a hearing aid system (consisting of one or more hearing aids, and potentially external devices). As a result of applying an MP-VAD algorithm, for each time-frequency tile of the noisy signal, estimates $\hat{\lambda}_V(m)$, $\hat{\lambda}_X(m)$, $\hat{d}(m)$, and a VAD decision are available. We assume that an estimate of $\hat{C}_V(m_0)$ of the noise cpsd matrix is updated based on Y(m), whenever the MP-VAD declares a time-frequency unit to be speech absent.

Most multi-microphone speech enhancement methods rely on signal statistics (often second-order) which may be readily reconstructed from the estimates above. Specifically, an estimate of the target speech inter-microphone cross-power spectral density matrix may be constructed as $$\hat{C}_S(m)=\hat{\lambda}_X(m)\hat{d}(m)\hat{d}^H(m),$$

while an estimate of the corresponding noise covariance matrix is given by $$\hat{C}_V(m)=\hat{\lambda}_V(m)\hat{C}_V(m_0).$$

From these estimated matrices, it is well-known that the filter coefficients of a multi-microphone Wiener filter are given by [1]:

$$W_{MWF}(m)=\hat{C}_S(m)(\hat{C}_S(m)+\hat{C}_V(m))^{-1}.$$

Alternatively, the filter coefficients of a Minimum-Variance Distortion-less Response (MVDR) beamformer can be found from the available information as (e.g. [6]):

$$W_{MVDR}(m)=\frac{\hat{C}_V^{-1}(m)\hat{d}(m)}{\hat{d}^H(m)\hat{C}_V^{-1}(m)\hat{d}(m)}.$$

An estimate of the underlying noise-free spectral coefficient is then given by $$\hat{S}(m)=W^H(m)Y(m),$$

where $W^H(m)$ is a vector comprising multi-microphone filter coefficients, e.g. the ones outlined above. Any of the multi-microphone filters outlined above may be applied to time-frequency tiles which were judged by the MP-VAD to contain speech activity.

The time-frequency tiles which were judged by MP-VAD to have no speech activity, i.e., they are dominated by whatever noise is present, may be processed in a simpler manner. Their energy may simply be suppressed, i.e., $$\hat{S}(m)=G_{noise}Y_{i_{ref}}(m),$$

where $0 \leq G_{noise} \leq 1$ is a suppression factor applied to noise-only time-frequency tiles of the reference microphone, e.g., $G_{noise}=0.1$.

Obviously, other estimators which depend on second-order signal statistics (i.e., noisy, target, and noise cpsd matrices) may be applied in a similar manner.

Figure 7:
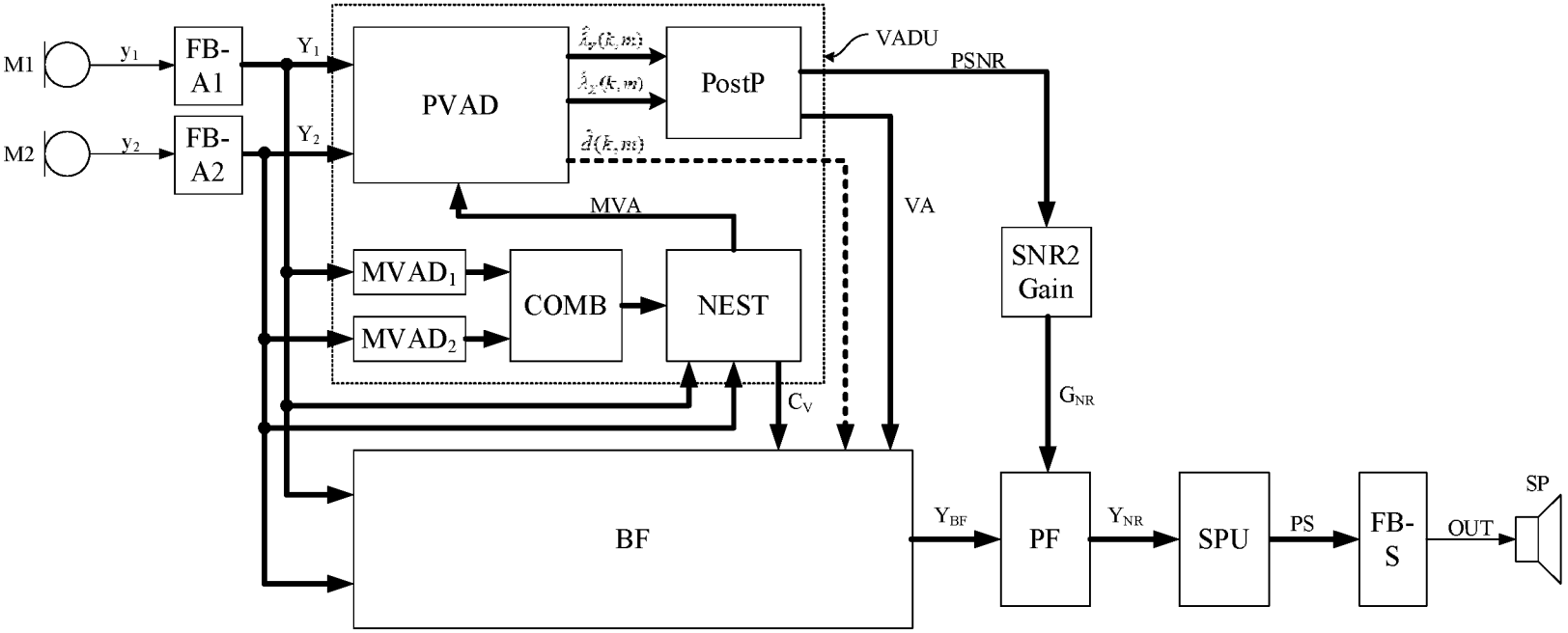
FIG. 7 shows a hearing device comprising a voice activity detection unit according to an embodiment of present disclosure.

FIG. 7 shows a hearing device, e.g. a hearing aid, comprising a voice activity detection unit according to an embodiment of present disclosure. The hearing device comprises a voice activity detection unit (VADU) as described above, e.g. in FIG. 4. The voice activity detection unit (VADU) of FIG. 7 differs in that is contains two second detectors ($MVAD_1$, $MVAD_2$), one for each of the electric inputs signals ($Y_1$, $Y_2$) and consequently a following combination unit (COMB) for providing a resulting preliminary voice activity detection estimate, which is fed to a noise estimation unit (NEST) for providing a current noise covariance matrix $\tilde{C}_v(k,m_0)$, $m_0$ being the last time where the noise covariance matrix has been determined (where the resulting preliminary voice activity detection estimate defined that speech was absent). The resulting preliminary voice activity detection estimate MVA (e.g. equal to or comprising the current noise covariance matrix $\tilde{C}_v(k,m_0)$ is used as input to the first detector (PVAD) and—based thereon (and on the first and second electric input signals ($Y_1$, $Y_2$))—providing estimates of power spectral densities $\hat{\lambda}_x(k,m)$ and $\hat{\lambda}_V(k,m)$ of the target signal and the noise signal, respectively, and an estimate of a look vector $\hat{d}(k,m)$. The parameters provided by the first detector are fed to the post-processing unit (PostP) providing (spatial) signal to noise ratio PSNR ($\hat{\lambda}_x(k,m)/\hat{\lambda}_V(k,m)$) and voice activity detection estimate VA(k,m). The latest noise covariance matrix $\hat{C}_v(k,m_0)$ is fed to the beamformer filtering unit (BF), cf. signal $C_V$. The hearing device comprises a multitude M of input transducers, e.g. microphones, here two (M1, M2) each providing respective time domain signals ($y_1$, $y_2$) and corresponding analysis filter banks (FB-A1, FB-A2) for providing respective electric input signals ($Y_1$, $Y_2$) in a time-frequency representation $Y_i(k,m)$, i=1, 2. The hearing device comprises an output transducer, e.g., as shown here, a loudspeaker (SP) for presenting a processed version OUT of the electric input signal(s) to a user wearing the hearing device. A forward path is defined between the input transducers (M1, M2) and the output transducer (SP). The forward path of the hearing device further comprises a multi-input beamformer filtering unit (BF) for spatially filtering M input signals, here $Y_i(k,m)$, i=1, 2, and providing a beamformed signal $Y_{BF}(k,m)$. The beamformer filtering unit (BF) is controlled in dependence of one or more signals from the voice activity detection unit (VADU), here the voice activity detection estimate VA(k,m), and the estimate of the noise covariance matric $C_V(k,m)$, and optionally, an estimate of the look vector $\hat{d}(k,m)$. The hearing device further comprises a single channel post filtering unit (PF) for providing a further noise reduction of the spatially filtered, beamformed signal $Y_{BF}$ (cf signal $Y_{NR}$). The hearing device comprises a signal to noise ratio-to-gain conversion unit (SNR2Gain) for translating a signal to noise ratio PSNR estimated by the voice activity detection unit (VADU) to a gain $G_{NR}(k,m)$, which is applied to the beamformed signal $Y_{BF}$ in the single channel post filtering unit (PF) to (further) suppress noise in the spatially filtered signal $Y_{BF}$. The hearing device further comprises a signal processing unit (SPU) adapted to provide a level and/or frequency dependent gain according to a user's particular needs to the further noise reduced signal $Y_{NR}$ from the single channel post filtering unit (PF) and to provide a processed signal PS. The processed signal is converted to the time domain by synthesis filter bank FB-S providing processed output signal OUT.

Other embodiments of the voice activity detection unit (VADU) according to the present disclosure may be used in combination with the beamformer filtering unit (BF) and possibly post filter (PF).

The hearing device shown in FIG. 7 may e.g. represent a hearing aid.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[1] P. C. Loizou, "Speech Enhancement—Theory and Practice," CRC Press, 2007.

[2] R. C. Hendriks, T. Gerkmann, J. Jensen, "DFT-Domain Based Single-Microphone Noise Reduction for Speech Enhancement—A Survey of the State-of-the-Art," Morgan and Claypool, 2013.

[3] M. Souden et al., "Gaussian Model-Based Multichanel Speech Presence Probability," IEEE Transactions on Audio, Speech. and Language Processing, Vol. 18, No. 5. July 2010, pp. 1072-1077.

[4] J. S. Bradley, H. Sato, and M. Picard, "On the importance of early reflections for speech in rooms," J. Acoust. Soc. Am., vol. 113, no. 6, pp. 3233-3244, 2003.

[5] A. Kuklasinski, "Multi-Channel Dereverberation for Speech Intelligibility Improvement in Hearing Aid Applications," Ph.D. Thesis, Aalborg University, September 2016.

[6] K. U. Simmer, J. Bitzer, and C. Marro, "Post-Filtering Techniques," Chapter 3 in M. Brandstein and D). Ward (eds.), "Microphone Arrays—Signal Processing Techniques and Applications," Springer, 2001.

[7] S. Haykin, "Adaptive Filter Theory," Prentice-Hall International, Inc., 1996.

[8] J. Thiemann et al., Speech enhancement for multimicrophone binaural hearing aids aiming to preserve the spatial auditory scene, Eurasip Journal on Advances in Signal Processing, No. 12, pp. 1-11, 2016.

The invention claimed is:

1. A voice activity detection unit (VADU) configured to receive a time-frequency representation $Y_i(k,m)$ of at least two electric input signals, i=1, . . . , M, in a number of frequency bands and a number of time instances, k being a frequency band index, m being a time index, and specific values of k and m defining a specific time-frequency tile of said electric input signals, the electric input signals comprising a target speech signal originating from a target signal source and/or a noise signal, the voice activity detection unit being configured to provide a resulting voice activity detection estimate comprising one or more parameters indicative of whether or not a given time-frequency tile contains or to what extent it comprises the target speech signal, wherein said voice activity detection unit comprises a first detector (PVAD) for analyzing said time-frequency representation $Y_i(k,m)$ of said electric input signals and identifying spectro-spatial characteristics of said electric input signal, and for providing said resulting voice activity detection estimate in dependence of said spectro-spatial characteristics, and a second detector for analyzing said time-frequency representation $Y_i(k,m)$ of one or more of said at least two electric input signals and identifying spectro-temporal characteristics of said electric input signal(s), and providing a preliminary voice activity detection estimate in dependence of said spectro-temporal characteristics; and said preliminary voice activity detection estimate is provided as an input to said first detector.

2. A voice activity detection unit according claim 1 configured to provide that said voice activity detection estimate is represented by or comprises an estimate of the power or energy content originating a) from a point-like sound source, and b) from other sound sources, respectively, in one or more, or a combination, of said at least two electric input signals at a given point in time.

3. A voice activity detection unit according to claim 1 wherein the spectra-spatial characteristics comprises an estimate of a direction to or a location of the target signal source.

4. A voice activity detection unit according to claim 1 wherein the voice activity detection unit comprises or is connected to at least two input transducers for providing said electric input signals, and wherein the spectro-spatial characteristics comprises acoustic transfer function(s) from the target signal source to the at least two input transducers or relative acoustic transfer function(s) from a reference input transducer to at least one further input transducer among said at least two input transducers.

5. A voice activity detection unit according to claim 1 wherein said spectro-spatial characteristics comprises an estimate of a target signal to noise ratio for each time-frequency tile (k,m).

6. A voice activity detection unit according to claim 4 wherein an estimate of the target signal to noise ratio for each time-frequency tile (k,m) is determined by an energy ratio of an estimate of the power spectral density of the target signal at an input transducer to the power spectral density of the noise signal at said input transducer.

7. A voice activity detection unit (VADU) configured to receive a time-frequency representation $Y_i(k,m)$ of at least two electric input signals, i=1, . . . , M, in a number of frequency bands and a number of time instances, k being a frequency band index, m being a time index, and specific values of k and m defining a specific time-frequency tile of said electric input signals, the electric input signals comprising a target speech signal originating from a target signal source and/or a noise signal, the voice activity detection unit being configured to provide a resulting voice activity detection estimate comprising one or more parameters indicative of whether or not a given time-frequency tile contains or to what extent it comprises the target speech signal, wherein said voice activity detection unit comprises a first detector (PVAD) for analyzing said time-frequency representation $Y_i(k,m)$ of said electric input signals and identifying spectro-spatial characteristics of said electric input signals, and for providing said resulting voice activity detection estimate in dependence of said spectro-spatial characteristics; and a second detector providing a preliminary voice activity detection estimate based on analysis of amplitude modulation of one or more of said at least two electric input signals and wherein said first detector provides data indicative of the presence or absence of point-like sound sources, based on a combination of the at least two electric input signals and said preliminary voice activity detection estimate.

8. A voice activity detection unit according to claim 1 wherein said spectro-temporal characteristics comprises a measure of modulation, pitch, or a statistical measure of said electric input signal, or a combination thereof.

9. A voice activity detection unit (VADU) configured to receive a time-frequency representation $Y_i(k,m)$ of at least two electric input signals, i=1, . . . , M, in a number of frequency bands and a number of time instances, k being a frequency band index, m being a time index, and specific values of k and m defining a specific time-frequency tile of said electric input signals, the electric input signals comprising a target speech signal originating from a target signal source and/or a noise signal, the voice activity detection unit being configured to provide a resulting voice activity detection estimate comprising one or more parameters indicative of whether or not a given time-frequency tile contains or to what extent it comprises the target speech signal, wherein said voice activity detection unit comprises a first detector (PVAD) for analyzing said time-frequency representation $Y_i(k,m)$ of said electric input signals and identifying spectro-spatial characteristics of said electric input signals, and for providing said resulting voice activity detection estimate in dependence of said spectro-spatial characteristics, and a second detector for analyzing said time-frequency representation $Y_i(k,m)$ of one or more of said at least two electric input signals and identifying spectro-temporal characteristics of said electric input signal(s), and providing a preliminary voice activity detection estimate in dependence of said spectra-temporal characteristics; and said preliminary voice activity detection estimate of said second detector provides a preliminary indication of whether speech is present or absent in a given time-frequency tile (k,m) of the electric input signal, and wherein the first detector is configured to further analyze the time-frequency tiles (k",m") for which the preliminary voice activity detection estimate indicates the presence of speech.

10. A voice activity detection unit according to claim 9 wherein the first detector is configured to further analyze the time-frequency tiles (k",m") for which the preliminary voice activity detection estimate indicates the presence of speech with a view to whether the sound energy is estimated to be directive or diffuse, corresponding to the resulting voice activity detection estimate indicating the presence or absence of speech from the target signal source, respectively.

11. A voice activity detection unit according to claim 1 wherein the first detector is configured to base the voice activity detection estimate comprising data indicative of the presence or absence of point-like sound sources on a signal model.

12. A voice activity detection unit according to claim 11 wherein the signal model assumes that target signal X(k,m) and noise signals V(k,m) are un-correlated so that a time-frequency representation of an $i^{th}$ electric input signal $Y_i(k,m)$ can be written as $Y_i(k,m)=X_i(k,m)+V_i(k,m)$, where k is a frequency index, and m is a time (frame) index.

13. A hearing device, e.g. a hearing aid, comprising a voice activity detection unit according to claim 1.

14. A hearing device according to claim 11 constituting or comprising a hearing aid, a headset, an earphone, an ear protection device or a combination thereof.

15. A hearing device according to claim 10 comprising a multitude M of input units, e.g. input transducers, e.g. microphones, each providing an electric hearing device input signal, and respective analysis filter banks for providing each of said electric hearing device input signals in a time-frequency representation $Y_i(k,m)$, i=1, . . . , M, and wherein the electric input signals to the voice activity detection unit are equal to or originate from said electric hearing device input signals.

16. A hearing device according to claim 11 comprising a multi-input beamformer filtering unit for spatially filtering said M electric hearing device input signals $Y_i(k,m)$, i=1, . . . , M, where M≥2, and providing a beamformed signal, and wherein the beamformer filtering unit is controlled in dependence of one or more signals from the voice activity detection unit.

17. A hearing system comprising a hearing device according to claim 1 and an auxiliary device, wherein the hearing system is adapted to establish a communication link between the hearing device and the auxiliary device to provide that information can be exchanged between or forwarded from one to the other.

* * * * *